US005890049A

United States Patent [19]

Williams et al.

[11] Patent Number: 5,890,049

[45] Date of Patent: Mar. 30, 1999

[54] TRANSLUCENT REMOVABLE VIEWING WINDOW FOR OPTICAL VIEWING THE LEVEL OF DEVELOPER MATERIAL IN A WASTE DEVELOPER BOTTLE

[75] Inventors: Brent A. Williams, Penfield; Samuel P. Mordenga; Bruce C. Reynolds, both of Rochester; Michael J. Palencar, Webster; Albert J. Wersinger, Williamson, all of N.Y.

[73] Assignee: Xerox Corporation, Stamford, Conn.

[21] Appl. No.: 887,347

[22] Filed: Jun. 24, 1997

[51] Int. Cl.[6] ..... G03G 15/00

[52] U.S. Cl. ..... 399/360; 399/35; 399/120

[58] Field of Search ..... 399/35, 98, 120, 399/360, 358

[56] References Cited

U.S. PATENT DOCUMENTS 4,711,561 12/1987 Tsuruoka ..... 399/35
4,768,062 8/1988 Tanzawa et al. ..... 399/358

FOREIGN PATENT DOCUMENTS 2-266365 10/1990 Japan .

*Primary Examiner*—Arthur T. Grimley
*Assistant Examiner*—Quana Grainger
*Attorney, Agent, or Firm*—Lloyd Bean, II

[57] ABSTRACT

A sensing system is disclosed for detecting a full condition within a waste developer system, the sensing system including: a developer waste bottle for receiving and holding waste developer material including toner and carrier deposited therein from the developer system, the developer waste bottle having a translucent, removable viewing window for optical viewing the level of developer material therein, the viewing window comprises a sensing portion in fluid communication with the developer waste bottle, the sensing portion adapted to have developer material flow therein when the magnetic material in the toner waste bottle reaches the predetermined level. A sensor assembly is mounted exterior to the developer waste bottle and in optical communication with the viewing window, the sensor being responsive to the level magnetic material in the developer waste bottle when the magnetic material in the toner waste bottle reaches the predetermined level The sensing portion defines a cavity therein, the cavity being partly enclosed by a protective baffle for preventing airborne toner from depositing in the cavity. The reusable waste bottle is black in color while the removable window is translucent, permitting the use of an optical sensor for determining when the waste has reached the level of the window. Because the bottle is black, it can be easily refurbished by simply removing the window and either cleaning the window or installing a new one.

2 Claims, 4 Drawing Sheets

TRANSLUCENT REMOVABLE VIEWING WINDOW FOR OPTICAL VIEWING THE LEVEL OF DEVELOPER MATERIAL IN A WASTE DEVELOPER BOTTLE

BACKGROUND OF THE INVENTION

This invention relates to electrophotographic copiers and duplicators and, more particularly to a reusable developer waste bottle and an indicating system for warning a machine operator of impending over filling of the waste bottle.

In the process of electrostatographic printing, an electrostatic charge pattern or latent image corresponding to an original document to be reproduced is recorded on an insulating medium. A viewable record is produced by developing the latent image with particles of granulated material to form a powder image thereof. Thereafter, the visible powder image is fused to the insulating medium, or transferred to a suitable support material and fused thereto. Development of the latent image is achieved by bringing a developer mix into contact therewith. Typical developer mixes generally comprise dyed or colored thermoplastic particles of granulated material known in the art as toner particles, which are mixed with carrier granules, such as ferromagnetic granules. When appropriate, toner particles are mixed with carrier granules and the toner particles are charged triboelectrically to the correct polarity. As the developer mix is brought into contact with the electrostatic latent image, the toner particles adhere thereto. However, as toner particles are depleted from the developer mix, additional toner particles (simply "toner" hereafter) must be supplied. In this way, the concentration of toner in the developer mix is maintained substantially constant.

In developer subsystems that employ so-called trickle development, a small amount of fresh carrier is included with the supply of toner which is dispensed by a dispensing apparatus into the developer subsystem. Generally, this system employs an overflow system in the housing of the developer subsystem which maintains the sump at a constant volume. Since new toner and carrier is constantly added to the developer subsystem, some excess or waste developer flows out through the overflow system via a hose or tube into a waste bottle.

In machines where the removal and replacement of waste bottles is a task performed by a Customer/User, it is highly desirable to have an accurate method for indicating when the waste bottle is full so that our Customers/Users are not dissatisfied by replacing a waste bottle which is not fully used.

Typically, the waste bottles tend to be made from polypropylene or polyethylene. A natural color is generally chosen because the bottle is used in conjunction with an optical sensor which indicates when the bottle is at its full capacity. These optical sensors consist of an emitter and a detector which detect when the bottle is full by looking through a view window on the bottle or through the bottle directly. A problem with such systems is that toner contamination on the view window can trigger false readings; when the inside of the bottle becomes dusty, the sensor misinterprets this condition as a full bottle.

An alternative methods that has been used in this type of application involves counting the number of copies since the bottle was last installed. This approach is not only indirect, but also inaccurate due to a wide variation in the amount of waste developer generated per copy. The inaccuracy correspondingly causes frequent bottle replacements and higher service costs. On the other hand, it has also been found that, in sensing systems where the sensor is placed within the developer material, reliability and the life expectancy of the sensor is at risk.

Therefore, there exists a need for a reliable system for providing an accurate warning to a machine operator of impending over filling of a developer waste bottle in combination with a reusable developer waste bottle which can be easily and cheaply refurbished for reuse.

BRIEF SUMMARY OF THE INVENTION

There is provided a sensing system for detecting a full condition within a waste developer system, the sensing system including: a developer waste bottle for receiving and holding waste developer material comprising toner and carrier deposited therein from the developer system, the developer waste bottle having a removable viewing window for optical viewing of the level of developer material therein, the viewing window comprises a sensing portion in fluid communication with the developer waste bottle, the sensing portion adapted to have developer material flow therein when the material in the developer waste bottle reaches the predetermined level. A sensor assembly is mounted exterior to the developer waste bottle and in optical communication with the viewing window, the sensor being responsive to the level of material in the developer waste bottle when the material in the developer waste bottle reaches the predetermined level. The waste bottle is black in color while the removable window is translucent, permitting the use of an optical sensor for determining when the waste has reached the predetermined level. Because the bottle is black, it can be easily refurbished by simply removing the window and either cleaning the window or installing a new one.

Other features of the present invention will become apparent as the following description proceeds and upon reference to the drawings.

DETAILED DESCRIPTION OF THE PREFERRED EMBODIMENT OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 5 printing machine will be shown hereinafter schematically and their operation described briefly with reference thereto.

Figure 1:
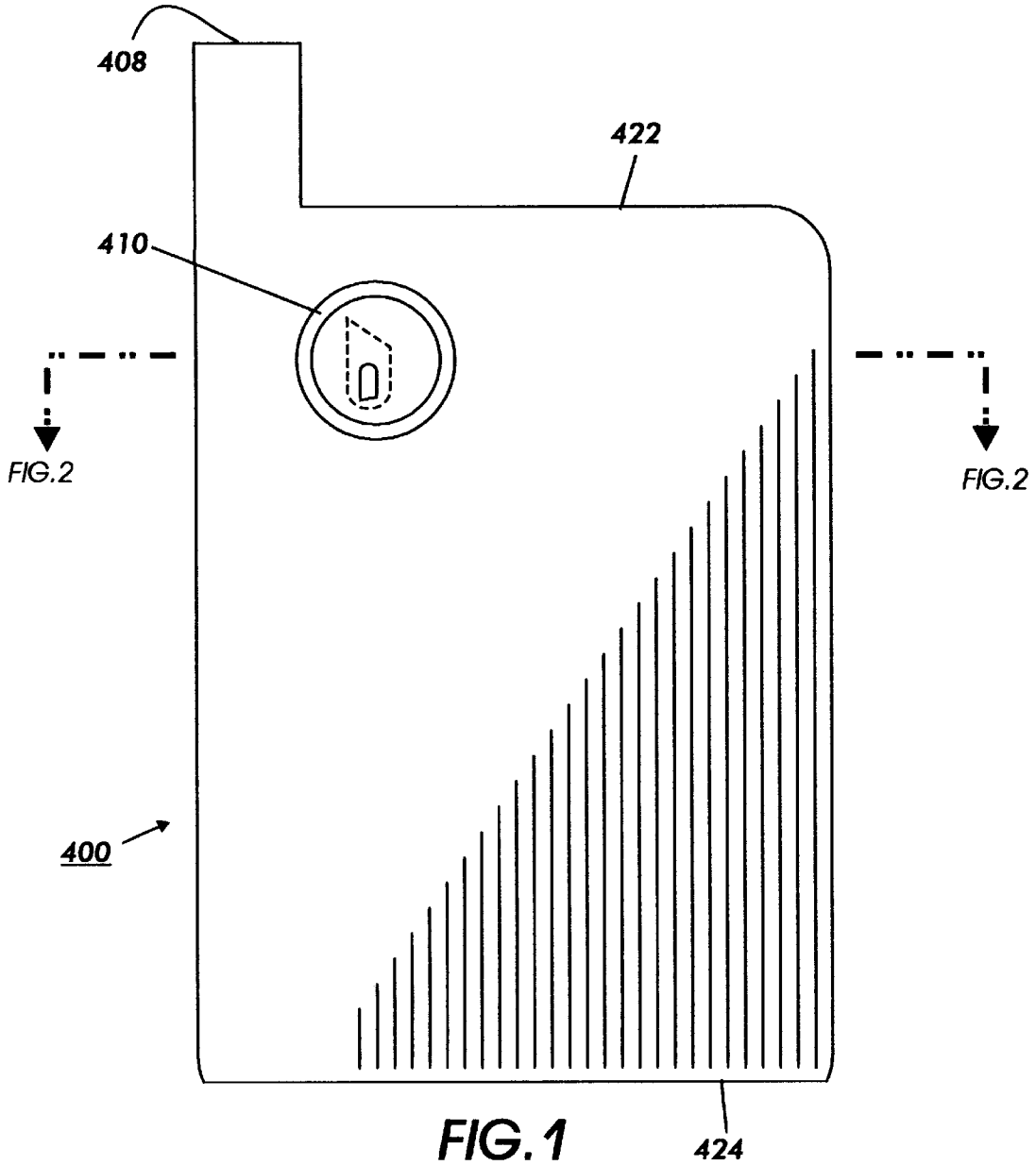
FIGS. 1–4 is a schematic elevational view showing an embodiment of the present invention.
Figure 2:
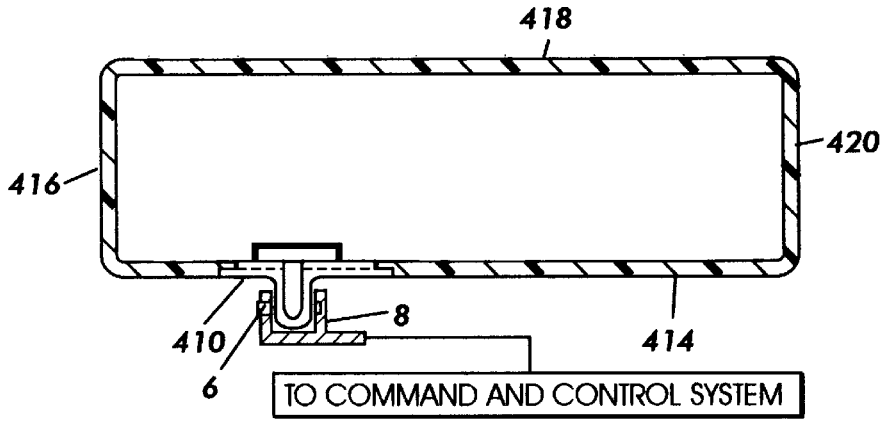
Figure 3A:
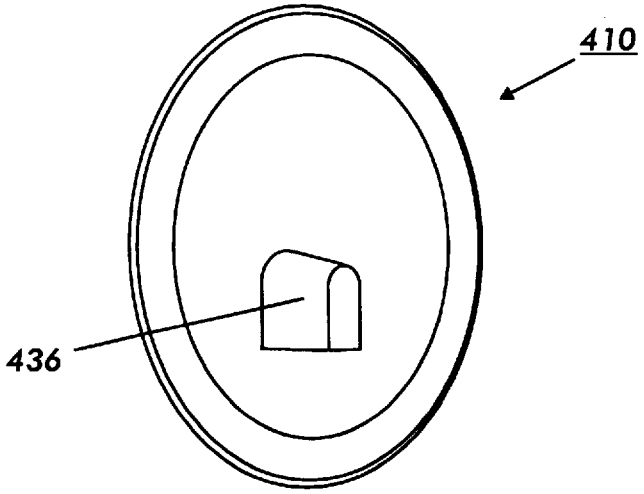
Figure 3B:
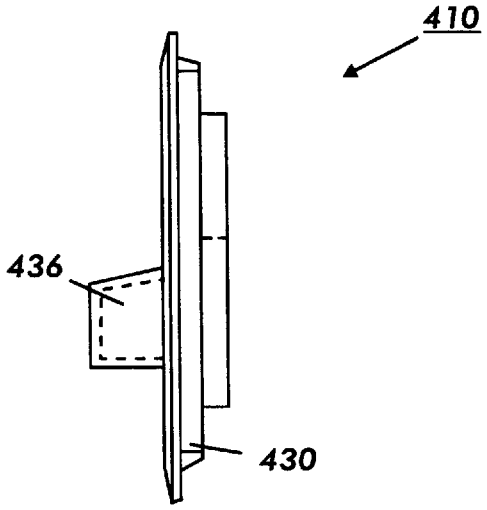
Figure 4A:
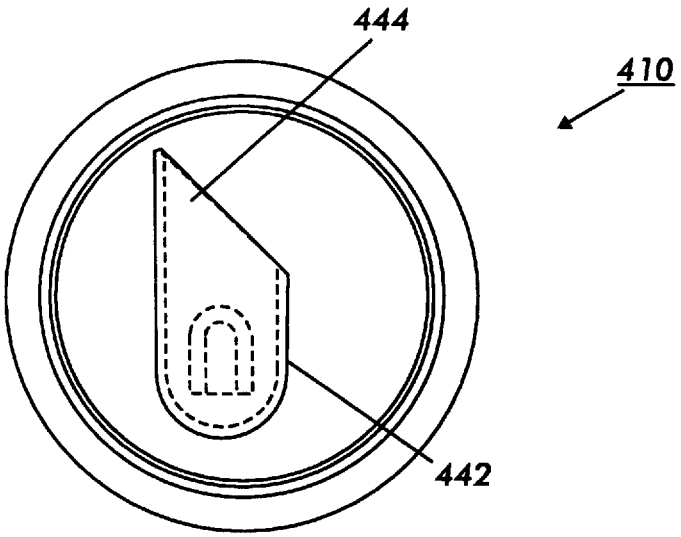
Figure 4B:
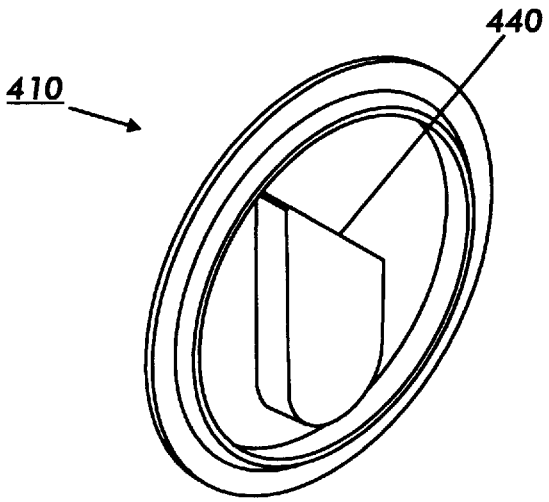
Figure 5:
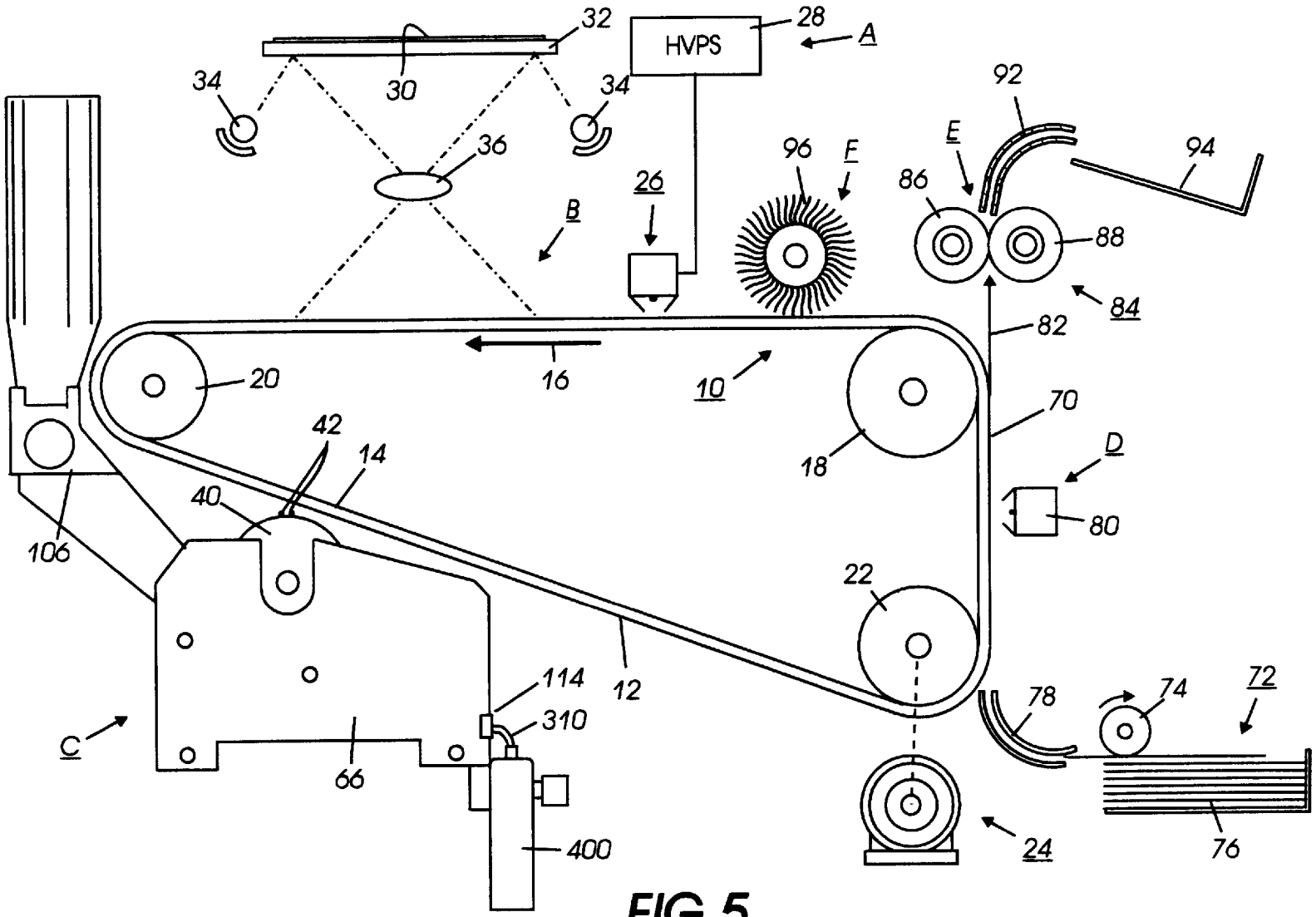
FIG. 5 is a schematic elevational view of an illustrative electrophotographic printing machine incorporating a waste bottle having the features of the present invention therein.

Referring initially to FIG. 5, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from selenium alloy. Conductive substrate 14 is made preferably from an aluminum alloy that is electrically grounded. One skilled in the art will appreciate that any suitable photoconductive belt may be used. Belt 10 moves in the direction of arrow 16 to advance successive portions of photoconductive surface 12 sequentially through the various processing stations disposed of throughout the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roll 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roll 40 is mounted, at least partially, in the chamber of developer housing 66. The chamber in developer housing 66 stores a supply of developer material. In one embodiment the developer material is a single component development material of toner particles, whereas in another the developer material includes at least toner and carrier.

With continued reference to FIG. 5, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

As successive electrostatic latent images are developed, the toner particles within the developer material are depleted. Toner is received from a toner dispenser indicated generally by reference numeral 110. The supply of toner is maintained in container 112 and is introduced to development sump 114 via auger 116 which is driven at a constant rate whenever motor 118 is energized by toner control system 120, as described in U.S. Pat. No. 5,081,491. As new toner with carrier enters sump 114, toner and carrier exits through overflow exit 300 and moves to waste toner bottle 400 via hose 310.

Referring to FIGS. 1–4, sensor 120 is mounted adjacent to waste bottle 400. Sensor 120 consists of LED emitter 6 and detector 8 which sense light passing through view window 410 in wastes bottle 400. As the carrier and toner rises to cover viewing window 410, the sensor perceives the change in the transmission of light and generates a waste bottle full signal. The signal can be sent to a user interface to indicate to the operator to replace the waste bottle and/or shut down the machine.

Waste bottle 400 is a container having four walls 414, 416, 418 and 420, a top 422 and a bottom 424. In top 422, there is located a waste input port 408 for receiving waste developer from developer sump 114 via hose 310. Viewing window 410 is located on wall 414 at a height in which it is desired for which the waste bottle is to be replaced. Viewing window 410 is removable from wall 414.

Viewing window 410 has flange portion 430 that snaps fits into bottle wall 414 and forms a tight seal with wall 414 to prevent toner leakage. Viewing window 410 is made from a translucent material such as natural polypropylene. Viewing window 410 includes a viewing bubble 436 which fits between LED emitter 6 and detector 8. Protective baffle 440 consists of a U-shaped wall 442 and a triangular back wall 444 which covers it. This baffle is open at the top to permit waste developer to enter bubble 436 when the waste reaches that predetermined level. Baffle 440 keeps bubble 436 clean from airborne toner when waste developer enters through input port 310 and from toner which splashes upward when it lands on the bottom of the waste bottle, thereby preventing false readings of the sensor assembly.

An advantageous feature of the present invention is making the developer waste bottle out of black plastic and adding a removable, translucent viewing window at a location where the optical sensor observes the level of the bottle contents. This configuration allows reuse of the bottle without extensive cleaning, while simple cleaning or replacing of the viewing window ensures the ability of the machine to sense the bottle full condition.

It is, therefore, apparent that there has been provided in accordance with the present invention that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. In a sensing system for detecting a full condition within a waste developer system, said sensing system comprising:

a developer waste bottle for receiving and holding waste developer material comprising toner and carrier deposited therein from the developer system, said developer waste bottle having a translucent, removable viewing window for optical viewing the level of developer material therein, said viewing window comprises a sensing portion in fluid communication with said developer waste bottle, said sensing portion defines a cavity therein for allowing developer material flow therein when the developer material in said waste bottle reaches said predetermined level, said cavity being partly enclosed by a protective baffle for preventing airborne toner from depositing in said cavity;

a sensor assembly mounted exterior to the developer waste bottle and in optical communication with said viewing window, said sensor being responsive to the level of developer material in said cavity when the developer material in said waste bottle reaches a predetermined level.

2. The system of claim 1, wherein said sensor assembly includes a light source and a detector and wherein said sensing portion is interposed in between said light source and detector.

* * * * *